US005735024A

United States Patent [19]

Ortiz

[11] Patent Number: 5,735,024

[45] Date of Patent: Apr. 7, 1998

[54] FASTENING MECHANISM FOR CONNECTING ARTICLES AND THE LIKE TOGETHER

[76] Inventor: Kim A. Ortiz, 1500 W. Thornton Pwy. #292, Denver, Colo. 80221

[21] Appl. No.: 710,090

[22] Filed: Sep. 11, 1996

Related U.S. Application Data

[60] Provisional application No. 60/019,067, May 9, 1996.

[51] Int. Cl.[6] ..... A44B 11/00; A44B 11/25

[52] U.S. Cl. ..... 24/575; 24/573.1

[58] Field of Search ..... 24/575–578, 616, 24/615, 625, 633, 634, 170, 662, 659, 181, 629, 573.1, 312, 313

[56] References Cited

U.S. PATENT DOCUMENTS

| | | | |
|---|---|---|---|
| 3,520,033 | 7/1970 | Usuda | 24/575 |
| 3,836,049 | 9/1974 | Smith | 24/575 |
| 4,393,556 | 7/1983 | Yuda et al. | 24/662 |
| 4,557,377 | 12/1985 | Kasai | 24/625 |
| 4,569,106 | 2/1986 | Lovato | 24/575 X |
| 4,779,315 | 10/1988 | Kohus | 24/575 |
| 4,800,629 | 1/1989 | Ikeda | 24/170 |
| 4,864,700 | 9/1989 | Kasai | 24/573.1 |
| 4,894,890 | 1/1990 | Kasai | 24/573.1 |
| 4,947,527 | 8/1990 | Hennig | 24/575 |
| 5,203,058 | 4/1993 | Krauss | 24/575 |
| 5,392,616 | 2/1995 | Ballenegger | 24/575 X |

*Primary Examiner*—James R. Brittain
*Assistant Examiner*—Robert J. Sandy
*Attorney, Agent, or Firm*—Emery L. Tracy

[57] ABSTRACT

A fastening mechanism for releasably connecting a first article and a second article together is provided. The fastening mechanism comprises a first connecting element secured to the first article with the first element having a first male portion and a first female portion. A second connecting element is secured to the second article with the second element having second male portion and a second female portion. In operation of the device of the present invention, the first male portion of the first element matingly connects with the second female portion of the second element and the second male portion of the second element matingly connects with the first female portion of the first element wherein the first element releasably connects to the second element thereby releasably connecting the first article to the second article.

8 Claims, 7 Drawing Sheets

FASTENING MECHANISM FOR CONNECTING ARTICLES AND THE LIKE TOGETHER

The present application claims the benefit of provisional application Ser. No. 60/019,067 filed May 9, 1996.

BACKGROUND OF THE INVENTION

1. Field of the Invention

This invention relates generally to fastening mechanism for connecting articles and the like together and, more particularly, it relates to fastening mechanisms for connecting articles and the like together with the fastening mechanism having a pair of identical reversible interchangeable connector elements engageable with each other.

2. Description of the Prior Art

In the prior art, there exists different types of fasteners for connecting articles together. For example, in the Ikeda, U.S. Pat. No. 4,800,629, a buckle is described for coupling a first end and a second end of a belt or strap together. The buckle of the Ikeda patent includes a male connector part and a female connector part. Both the male part and the female part of the Ikeda patent's buckle each include an end portion for attaching the first end of the strap and the second end of the strap, respectively. The male connector part further includes a pair of generally parallel, laterally-spaced, flexible arms attached to and extending from the end portion thereof. The female connector part further includes a body portion having a pair of longitudinal slots for receiving the arms of the male connector part and an opening recessed in each of a pair of opposite sides of the body portion which intersects with the longitudinal slots.

In the Ikeda patent, coupling of the male connector part and the female connector part together is accomplished by aligning and inserting the flexible areas of the male connector part with the longitudinal slots in the body of the female connector part. The male connector part and the female connector part are moved toward one another until opposite outwardly protruding jamb portions on the arms are aligned with the openings on the body portion. To uncouple the male connector part and the female connector part of the Ikeda patent, the user presses the jamb portions of the arms toward on another until they clear the edges of the openings allowing the male connector part to be withdrawn from the female part connector.

There is an important disadvantage with respect to the construction of the above-described Ikeda patent's buckle and other known prior art buckles. As described above, the Ikeda patent's buckle is made up of a pair of dedicated male and female connector parts wherein the male connector part has a pair of male elements, i.e., the arms, and the female connector part has a pair of female elements, i.e., the slots. Therefore, the male and female connector parts are not functionally interchangeable such that another male connector part cannot be used in place of a female connector part or vice versa. For the consumer, this ordinarily means that even if only one or the other of the male and female connector parts of a buckle becomes lost or broken, an entirely new buckle must be purchased to replace both male and female parts since typically individual male and female connector parts cannot be purchased separately. Since, the original male or female connector part of the original buckle no longer serves any useful purpose, they must be disposed thereby increasing product waste.

For the manufacturer, the use of dedicated male and female parts, as described in the Ikeda patent, requires the fabrication of two different injection molds to construct the male and female connector parts. The end result is a significant increase in the manufacturing costs of the buckle. Also, if replacement of individual parts were actually available to consumers, pairs of the connector parts would need to be maintained in inventory by either the manufacturer or retailer to accommodate replacement of either connector part when the need arises. Once again, this translates into increased costs in both the manufacture and inventory for prior art buckle construction.

It is an object of the present invention to provide a fastening mechanism for connecting articles and the like together which quickly releasably secures the articles together.

It is another object of the present invention to provide to proved a fastening mechanism for connecting articles and the like together which does not require dedicated male and female connector elements or parts.

It is yet a further object of the present invention to provide a fastening mechanism for connecting articles and the like together which provides a pair of identical reversible interchangeable connector elements to releasably secure the articles together.

It is still a further object of the present invention to provide a fastening mechanism for connecting articles and the like together which encourages lower manufacturing, retail, and consumer costs while discouraging manufacturing, retail, and consumer product waste.

SUMMARY OF THE INVENTION

The present invention is a fastening mechanism for releasably connecting a first article and a second article together. The fastening mechanism of the present invention comprises a first connecting element secured to the first article with the first element having a first male portion and a first female portion. A second connecting element is secured to the second article with the second element having second male portion and a second female portion. In operation, the first male portion of the first element matingly connects with the second female portion of the second element and the second male portion of the second element matingly connects with the first female portion of the first element wherein the first element releasably connects to the second element thereby releasably connecting the first article to the second article.

In an embodiment of the present invention, the fastening mechanism comprises the first male portion of the first connecting element having a first arm and the second male portion of the second connecting element having a second arm. Preferably, the first arm of the first connecting element has a first protruding portion and the second arm of the second connecting element has a second protruding portion such that upon connecting the first connecting element to the second connecting element, the first protruding portion extends into the second female portion and the second protruding portion extends into the first female portion.

In another embodiment of the present invention, the fastening mechanism comprises the first and second protruding portions having a protuberance interacting with the first and second female portions, respectively. The protuberances inhibit the first and second protruding portions from disengaging from the first and second female portions.

In still another preferred embodiment, the fastening mechanism of the present invention comprises the first female portion of the first connecting element having a first slot formed in the first connecting element and the second female portion of the second connecting element having a second slot formed in the second connecting element. Furthermore, preferably, the first connecting element has a first guide bar and a first receiving opening with the first guide bar positioned adjacent the first male portion between the first male portion and the first female portion and the first receiving opening positioned adjacent the first female portion between the first guide bar and the first female portion. Also, preferably, the second connecting element has a second guide bar and a second receiving opening with the second guide bar positioned adjacent the second male portion between the second male portion and the second female portion and the second receiving opening positioned adjacent the second female portion between the second guide bar and the second female portion. Upon connecting the first connecting element to the second connecting element, the first receiving opening matingly receives the second guide bar and the second receiving opening matingly receives the first guide bar.

In still another preferred embodiment, the fastening mechanism of the present invention comprises the first connecting element and the second connecting element having a cross-sectional configuration selected from the group consisting of round, square, rectangular, triangular, hexagonal, and elliptical.

The present invention further includes a method of connecting a first article to a second article. The method of the present invention comprises securing a first connecting element to the first article. Next, a second connecting element is secured to the second article with the second connecting element being substantially identical to the first connecting element. Finally, the first connecting element is matingly connected with the second connecting element to releasably connect the first article to the second article.

In a preferred embodiment, the method of the present invention further comprises forming a first male portion onto the first connector element. Next, a first female portion is formed into the first connector element. Then, a second male portion is formed onto the second connector element. Next, a second female portion is formed into the second connector element. Finally, the first male portion is matingly connected to the second female portion and the second male portion to the first female portion thereby releasably connecting the first connector element to the second connector element.

In another preferred embodiment, the method of the present invention comprises the first male portion of the first connecting element having a first arm and the second male portion of the second connecting element having a second arm. Preferably, the first arm of the first connecting element has a first protruding potion and the second arm of the second connecting element has a second protruding portion such that upon connecting the first connecting element to the second connecting element, the first protruding portion extends into the second female portion and the second protruding potion extends into the first female portion.

In still another embodiment, the method of the present invention comprises the first and second protruding portions have a protuberance interacting with the first and second female portions, respectively. The protuberances inhibit the first and second protruding portions from disengaging the first and second female portions.

In yet another preferred embodiment, the method of the present invention comprises the first female portion of the first connecting element having a first slot formed in the first connecting element and the second female portion of the second connecting element having a second slot formed in the second connecting element. Furthermore, preferably, a first guide bar is formed onto the first connecting element adjacently positioned approximate the first male portion between the first male portion and the first female portion and a first receiving opening is formed into the first connecting element with the first receiving opening adjacently positioned approximate the first female portion between the first guide bar and the first female portion. Also, preferably, a second guide bar is formed onto the second connecting element adjacently positioned approximate the second male portion between the second male portion and the second female portion forming a second receiving opening into the second connecting element and the second receiving opening is formed in the second connecting element adjacently positioned approximate the second female portion between the second guide bar and the second female portion such that by connecting the first connecting element to the second connecting element, the first receiving opening matingly receives the second guide bar and the second receiving opening matingly receives by the first guide bar.

In yet a further embodiment, the method of the present invention comprises providing the first connecting element and the second connecting element with a cross-sectional configuration selected from the group consisting of round, square, rectangular, triangular, hexagonal, and triangular.

DETAILED DESCRIPTION OF THE PREFERRED EMBODIMENTS

Figure 1:
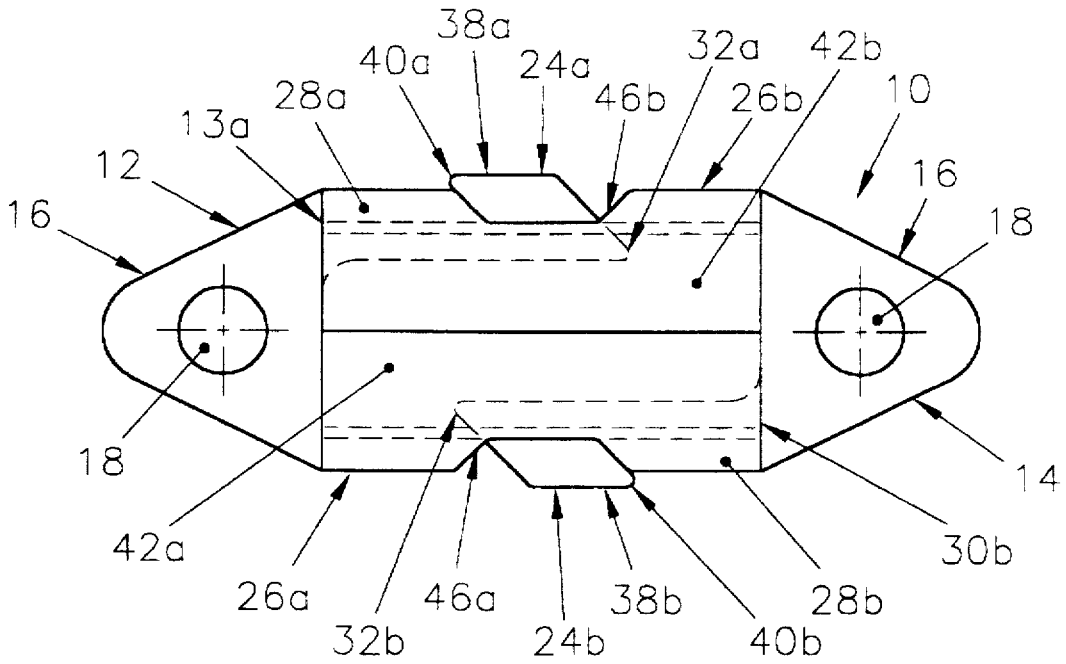
FIG. 1 is a top view of an embodiment of the fastening mechanism for connecting articles together according to the present invention illustrating the fastening mechanism comprising a connected pair of identical reversible interchangeable connector elements.
Figure 2:
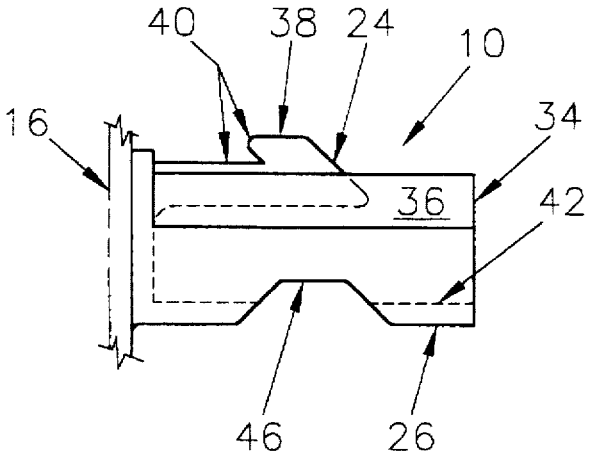
FIG. 2 is a top view of another embodiment of the fastening mechanism for connecting articles together according to the present invention illustrating one connector element of a disconnected pair of identical reversible interchangeable connector elements.

As illustrated in FIG. 1, the present invention is a fastening mechanism, indicated generally at 10, for connecting articles and the like together. While the fastening mechanism 10 of the present invention is being described herein for particular use with a strap (not shown) and the like having a first end, a second end, and a mid-portion, it should be noted that the fastening mechanism 10 of the present invention can be used on any type of article and not intended to be limited for use only on straps.

Figure 5:
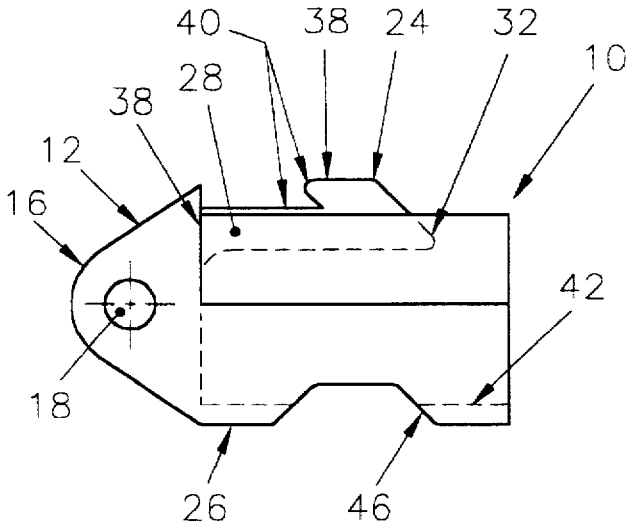
FIG. 5 is a top view of yet another embodiment of the fastening mechanism for connecting articles together according to the present invention illustrating one connector element of a disconnected pair of identical reversible interchangeable connector elements.
Figure 7:
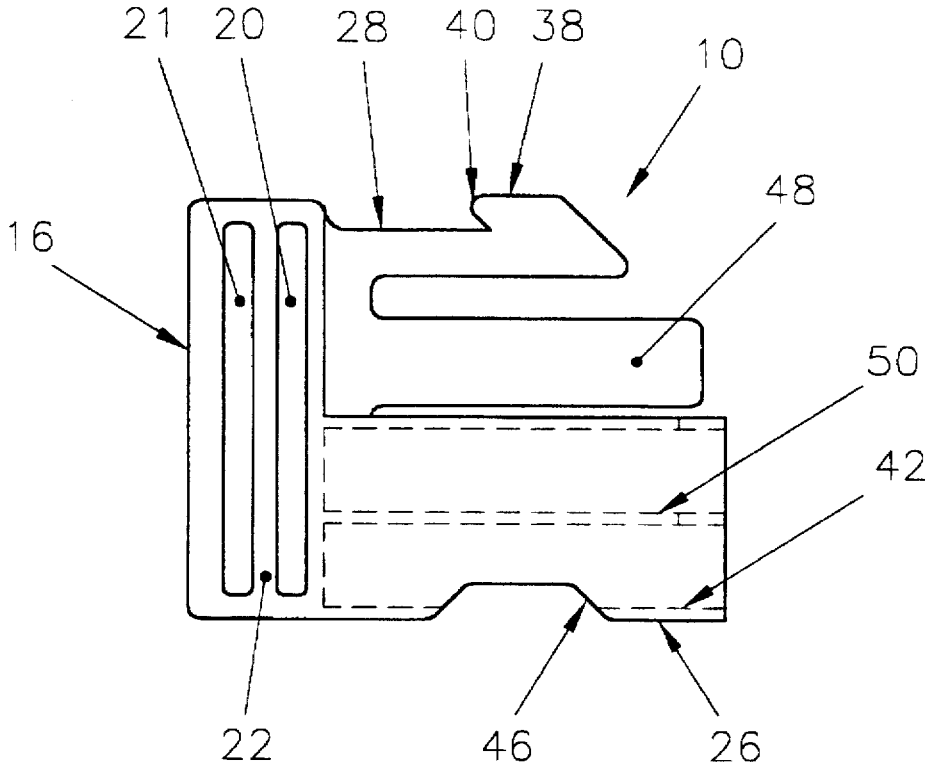
FIG. 7 is a top view of still another embodiment of the fastening mechanism for connecting articles together according to the present invention illustrating one connector element of a disconnected pair of identical reversible interchangeable connector elements.
Figure 9:
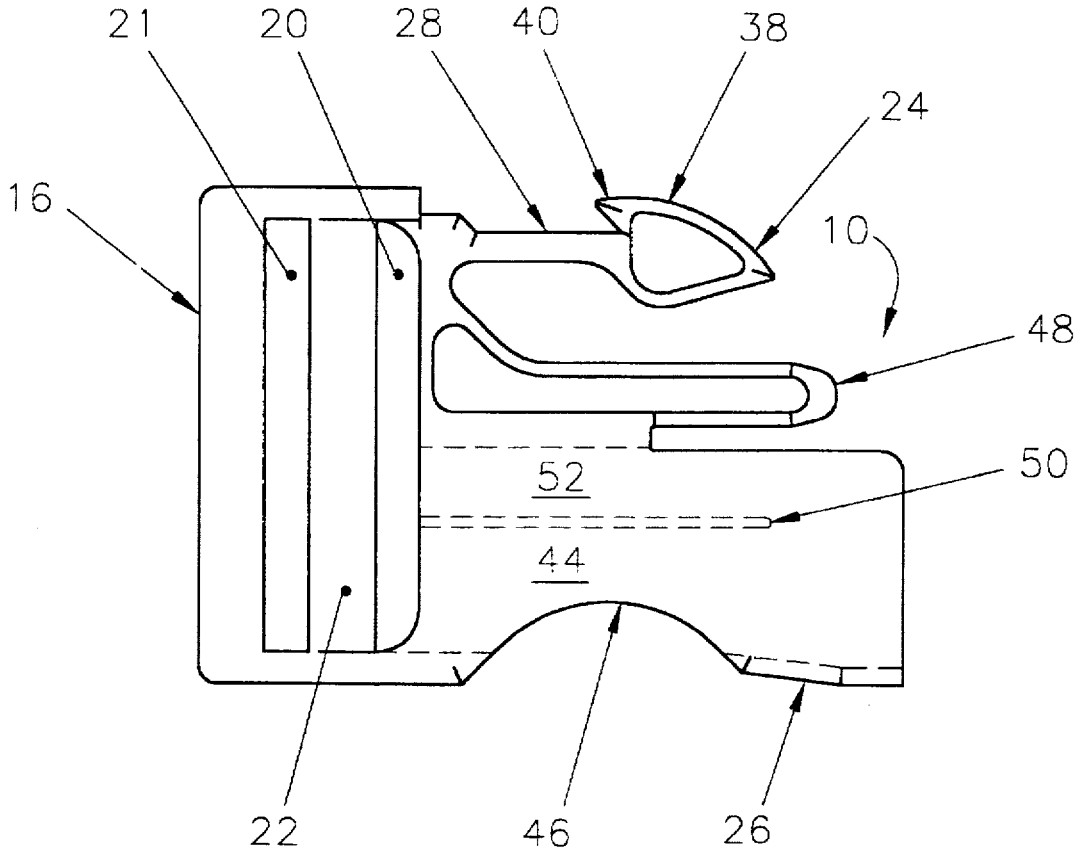
FIG. 9 is a top view of still yet another embodiment of the fastening mechanism for connecting articles together according to the present invention illustrating one connector element of a disconnected pair of identical reversible interchangeable connector elements.
Figure 10:
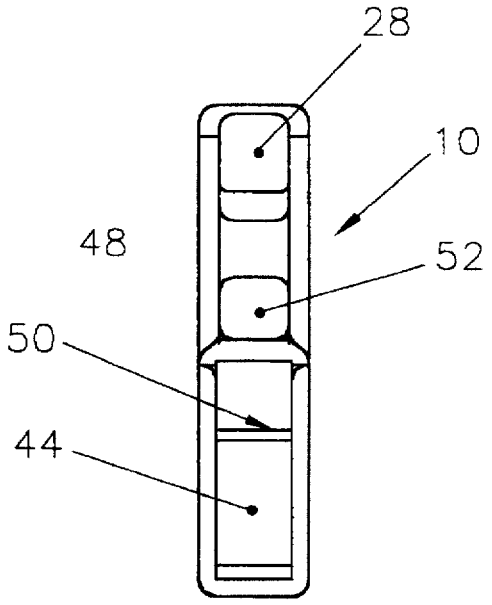
FIG. 10 is a cross-sectional view of the embodiment as illustrated in FIG. 9 of the fastening mechanism for connecting articles together according to the present invention illustrating a disconnected pair of identical reversible interchangeable connector elements having a rectangular cross-sectional configuration of the fastening mechanism.

Typically, the fastening mechanism 10 comprises a pair of connector elements, namely a first connector element 12 and a second connector element 14. Each of the connector elements has an attachment portion 16 at one end thereof. As illustrated in FIG. 1 and FIG. 5, the attachment portion 16 is formed as a single aperture 18 especially suited for attachment by rivet, screw, etc., of the fastening mechanism 10 directly to clothing, shoes, luggage, backpacks, containers, etc. without attaching the fastening mechanism first to a strap or the like. As illustrated in FIG. 7 and FIG. 9, the attachment portion is preferably formed as a plurality of strap-receiving slots 20, 21 separated and partially defined by at least one rib or bar 22. The strap-receiving slots 20 are especially suited for attachment of the fastening mechanism 10 directly to straps and the like.

Still referring to FIG. 7 and FIG. 9, in operation, to attach the fastening mechanism 10 to a single strap, the first end of the strap is inserted into the strap-receiving slot 20 of the first connector element 12. The strap is then directed over the rib 22 and into the strap-receiving slot 21. At that point, the first end of the strap is brought adjacent the mid-portion of the strap. The length of the strap adjusts by feeding additional amounts of the first end of the strap through the strap-receiving slots 20 in a known fashion. Preferably, the rib 22 includes at least one knurled surface (not shown) thereon for assisting in maintaining the strap in the strap-receiving slots 20, 21. The knurls frictionally react with the strap to prevent the first end of the strap from sliding or otherwise moving back through the strap-receiving slots 20, 21. The same procedure is repeated for the second end of the strap to be attached to the second connector element 14.

While the fastening mechanism 10 of the present invention has been described hereto as being connected to a single strap, it is within the scope of the present invention to attach the first connector element 12 to one strap and the second connector element 14 to a second strap. If desired, each of the straps could then be connected to an article such as a backpack, fanny pack, etc.

Referring to FIGS. 1–10, the first connector element 12 and a second connector element 14 further each have a male portion **24*a*, 24*b* extending along one side of the fastening mechanism 10 from the attachment portion 16 and a female portion 26*a*, 26*b* extending along the other side of the fastening mechanism 10 from the attachment portion 16. The male portions 24*a*, 24*b*, preferably, are in the form of a single flexible arm 28*a*, 28*e* having a first arm end 30*a*, 30*b* and a second arm end 32*a*, 32*b*, respectively. The first arm end 30*a*, 30*b* of the respective flexible arm 28*a*, 28*b* is attached to the respective attachment portion 16 and the second arm end 32*a*, 32*b* of the respective flexible arm 28*a*, 28*b*** extends freely therefrom.

In an embodiment of the fastening mechanism 10 of the present invention, as best illustrated in FIGS. 1–6, the fastening mechanism 10 comprises a male portion sleeve **34*a*, 34*b* having a single longitudinal slot 36*a*, 36*b*, respectively, formed in the respective male portion sleeve 34*a*, 34*b* which extends generally parallel and adjacent to the respective flexible arm 28*a*, 28*b* of the respective male portion 24*a*, 24*b*. Each male portion sleeve 34*a*, 34*b* is formed such that the respective male portion sleeve 34*a*, 34*b* receives at least a part of the respective flexible arm 28*a*, 28*b***.

The fastening mechanism 10 of the present invention also comprises a protruding portion **38*a*, 38*b* preferably adjacently formed at the respective second arm end 32*a*, 32*b* of the respective flexible arm 28*a*, 28*b*. As illustrated in FIG. 9, in a preferred embodiment of the fastening mechanism 10, the protruding portions 38*a*, 38*b* are shaped and designed to have an elliptical shape. It should be noted, however, that it is within the scope of the present invention to have protruding portion 38*a*, 38*b*** having a variety of shapes and designs, including square, rectangular, round, etc.

The fastening mechanism 10 of the present invention further comprises a protuberance 40 formed on each of the respective protruding portions **38*a*, 38*b* for assisting in releasably securing the first connector element 12 to the second connector element 14. Like the protruding portions 38*a*, 38*b*, the protuberances 40*a*, 40*b* can have a variety of shapes and designs. The operation and function of the protuberances 40*a*, 40*b*** will be described in further detail below.

The female portions **26*a*, 26*b* of the fastening mechanism 10 of the present invention is preferably in the form of a female portion sleeve 42*a*, 42*b* having a single longitudinal slot 44a, 44b, respectively, formed in each respective female portion sleeve 42a, 42b which extends generally parallel and adjacent to the respective flexible arm 28a, 28b of the male portion 24a, 24b. The female portion sleeve 42a, 42b is sized and shaped to receive the opposite flexible arm 28b, 28a, respectively, and includes a single recessed aperture 46a, 46b, respectively, formed therein which intersects the respective slot 44a, 44b and, in the embodiments illustrated in FIGS. 1–6, has a length approximately equal to the length of the respective male portion sleeve 34a, 34b. The recessed aperture 46a, 46b of each respective female portion 26a, 26b is sized and shaped to receive the opposite protruding portion 38b, 38a, respectively, and the opposite protuberance 40b , 40a, respectively, of the opposite flexible arm 28b, 28a** as will be described further below.

As illustrated in FIGS. 7–10, several embodiments of the fastening mechanism 10 of the present invention, the first and second connecting elements 12, 14 each include a guide bar 48a, 48b, respectively, extending from the respective attachment portion 16 adjacently parallel the respective flexible arm 28a, 28b and a guide plate 50a, 50b positioned within the respective female portion sleeve 42a, 42b between the respective guide bar 48a, 48b and the respective aperture 46a, 46b of the respective female portion sleeve 42a, 42b. The guide plate 50a, 50b and guide bar 48a, 48b together on each of the first connecting element 12 and the second connecting element 14 define an area 52a, 52b within the respective female portion sleeve 42a, 42b for receiving the guide bar 48b, 48a of the second connecting element 14 and the first connecting element 12, respectively, when the first connecting element 12 is connected to the second connecting element 14 as will be described further below. Furthermore, the guide bar 48a, 48b interacting with the opposite guide plate 50b, 50a, respectively, tend to inhibit accidental disengagement of the first connecting element 12 from the second connecting element 14 when the fastening mechanism 10 experiences rotational movement about its longitudinal axis.

While the embodiments of the fastening mechanism 10, as illustrated in FIGS. 7–10 have been described and illustrated as having each of the guide bars 48a, 48b positioned adjacent the respective flexible arm 28a, 28b and the guide plate 50a, 50b positioned between the respective guide bar 48a, 48b and the respective aperture 46a, 46b on each of the respective female portion sleeves 42a, 42b, it is within the scope of the present invention to have the guide bar 48a, 48b positioned adjacent the respective aperture 46a, 46b and the guide plate 50a, 50b positioned between the respective guide bar 48a, 48b and the respective flexible arm 28a, 28b. The purpose of the guide bars 48a, 48b and guide plates 50a, 50b remain the same, i.e., inhibiting accidental disengagement of the first connecting element 12 from the second connecting element 14.

Figure 3:
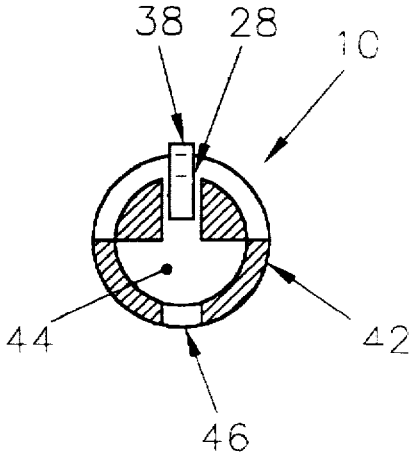
FIG. 3 is a cross-sectional view of the embodiment as illustrated in FIG. 1 of the fastening mechanism for connecting articles together according to the present invention illustrating a disconnected pair of identical reversible interchangeable connector elements having a round cross-sectional configuration of the fastening mechanism.
Figure 8:
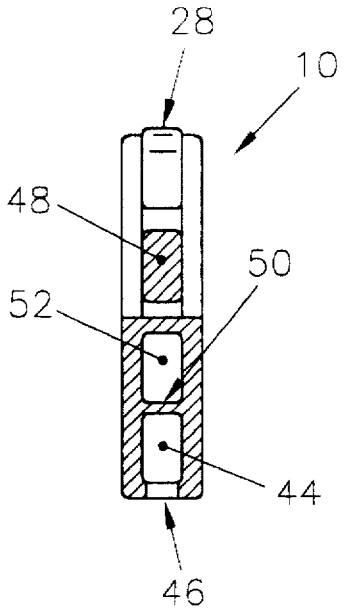
FIG. 8 is a cross-sectional view of the embodiment as illustrated in FIG. 7 of the fastening mechanism for connecting articles together according to the present invention illustrating a disconnected pair of identical reversible interchangeable connector elements having a rectangular cross-sectional configuration of the fastening mechanism.
Figure 4:
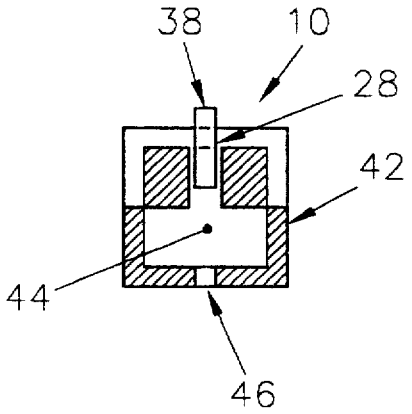
FIG. 4 is a cross-sectional view of the embodiment as illustrated in FIG. 1 of the fastening mechanism for connecting articles together according to the present invention illustrating a disconnected pair of identical reversible interchangeable connector elements having a square cross-sectional configuration of the fastening mechanism.
Figure 6:
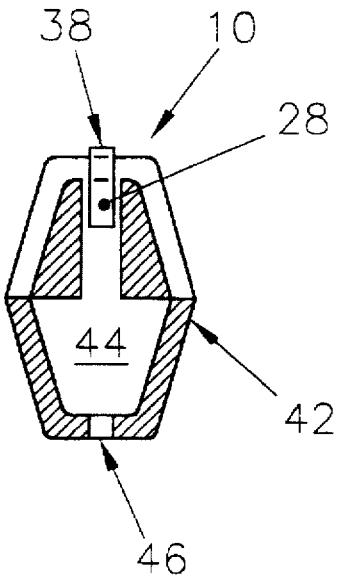
FIG. 6 is a cross-sectional view of the embodiment as illustrated in FIG. 5 of the fastening mechanism for connecting articles together according to the present invention illustrating a disconnected pair of identical reversible interchangeable connector elements having a hexagonal cross-sectional configuration of the fastening mechanism.
Figure 11:
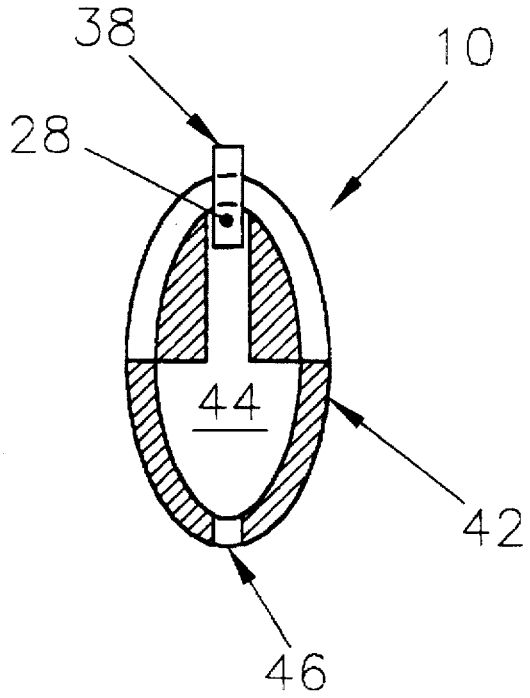
FIG. 11 is a cross-sectional view of the embodiment as illustrated in FIG. 1 of the fastening mechanism for connecting articles together according to the present invention illustrating a disconnected pair of identical reversible interchangeable connector elements having an elliptical cross-sectional configuration of the fastening mechanism.
Figure 12:
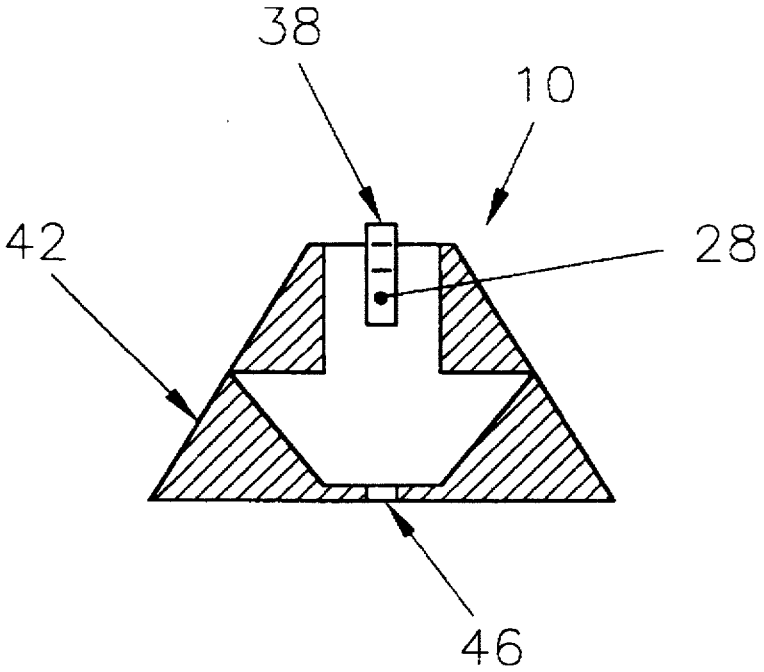
FIG. 12 is a cross-sectional view of the embodiment as illustrated in FIG. 1 of the fastening mechanism for connecting articles together according to the present invention illustrating a disconnected pair of identical reversible interchangeable connector elements having a triangular cross-sectional configuration of the fastening mechanism.
Figure 13:
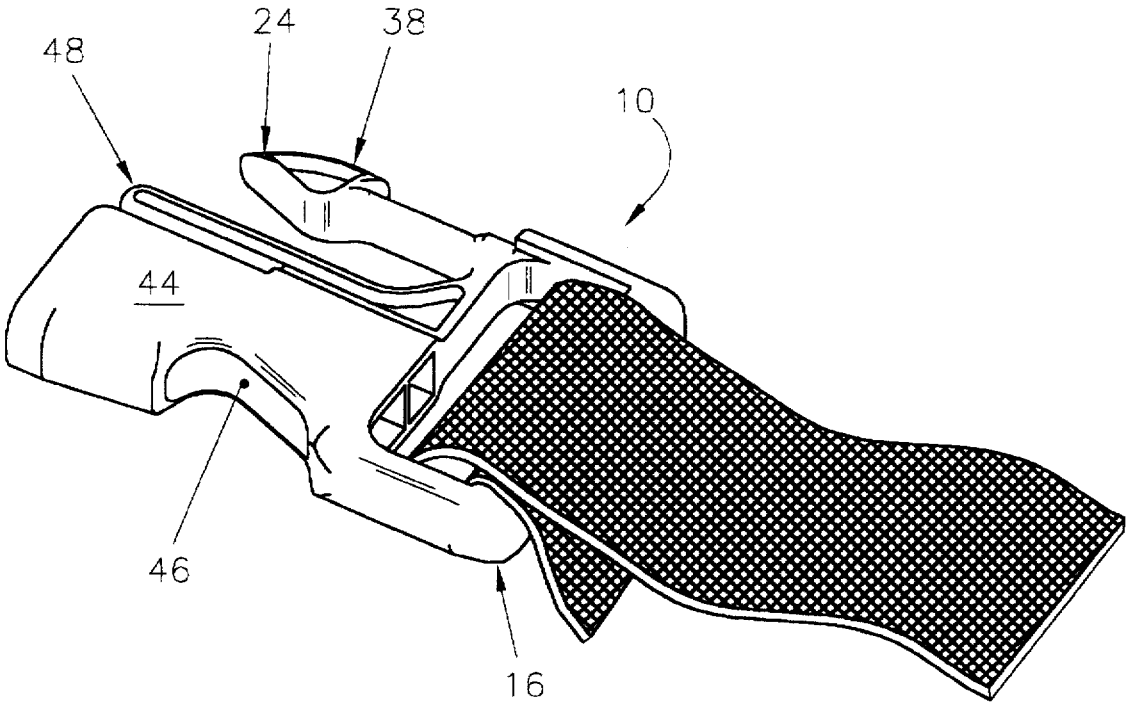
FIG. 13 is a perspective view of one connector element of a pair of a disconnected pair of identical reversible interchangeable connector elements as illustrated in FIG. 9 being secured to an article.
Figure 14:
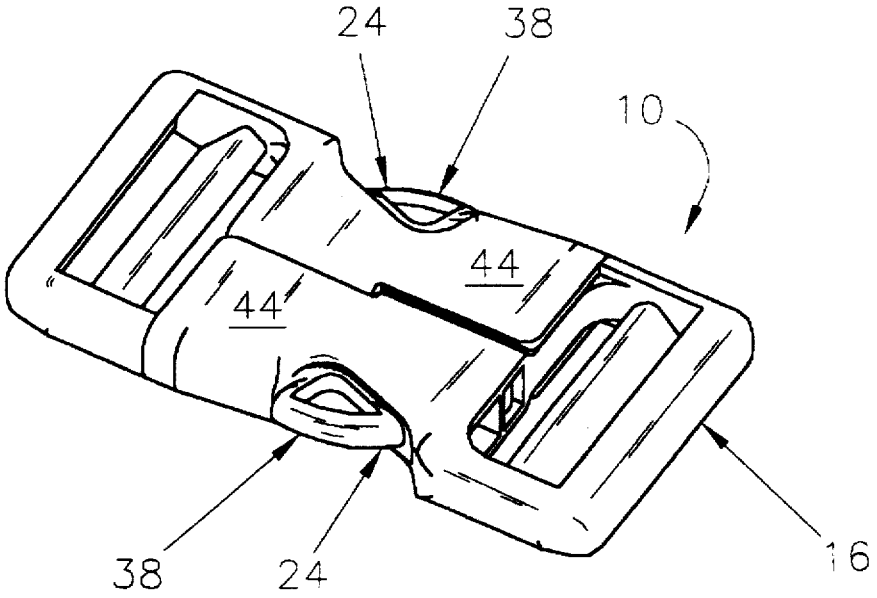
FIG. 14 is a perspective view of a connected pair of identical reversible interchangeable connector elements.
Figure 15:
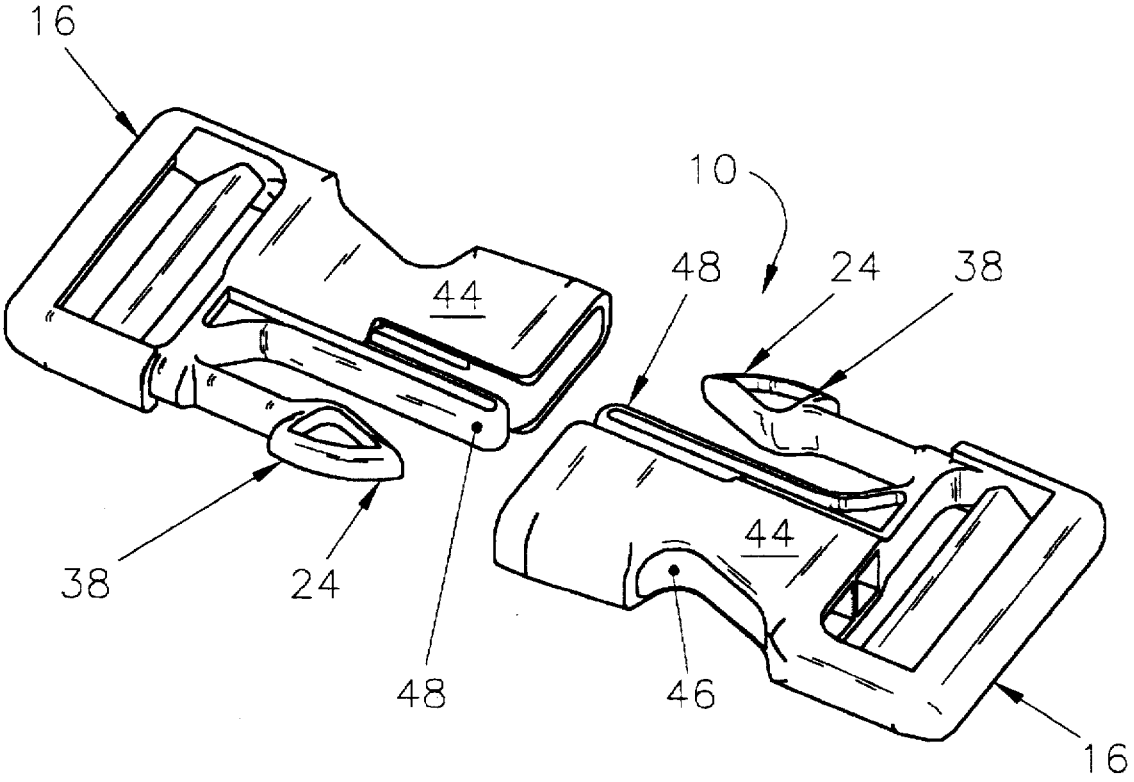
FIG. 15 is a perspective view of a disconnected pair of identical reversible interchangeable connector elements.

Referring to FIGS. 2–8 of the drawings, the fastening mechanism 10 of the present invention can have a variety of symmetrical geometric configurations in order to provide a fastening mechanism 10 having different shapes in accordance with the demands of fashion, consumer taste, and/or various applications for the fastening mechanism 10. As illustrated in FIGS. 2, 3, 4, 11, and 12, the fastening mechanism 10 can have a substantially round cross-sectional configuration as illustrated in FIG. 3, a substantially square cross-sectional configuration as illustrated in FIG. 4, a substantially elliptical cross-sectional configuration as illustrated in FIG. 11, or a substantially triangular cross-sectional configuration as illustrated in FIG. 12. As illustrated in FIGS. 5 and 6, the fastening mechanism 10 can have has a hexagonal cross-sectional configuration as illustrated in FIG. 6. As illustrated in FIGS. 7 and 8, the fastening mechanism 10 can have an approximately elongated rectangular cross-sectional configuration as illustrated in FIG. 8. It should be noted that the actual ornamental design of the fastening mechanism 10 of the present invention can be freely chosen by the manufacturer or user of the fastening mechanism 10. Since the design has no direct beating upon the construction and operation of the fastening mechanism 10 of the present invention, the designs illustrated in the drawings are merely preferred embodiments and other designs are, and should be considered, within the scope of the present invention.

The fastening mechanism 10 of the present invention is preferably constructed of a flexible, yet durable, plastic material, such as polypropylene, made by any suitable conventional fabrication technique, such as injection molding. It should be noted, however, that it is within the scope of the present invention to construct the fastening mechanism 10 from other types of material including, but not limited to, metal, aluminum, wood, ceramic, etc. Also, other fabrication techniques, while not specifically named herein, can be used to construct the fastening mechanism 10 and are within the scope of the present invention.

The procedure of engaging the first connecting element 12 with the second connecting element 14 will now be described. In operation of the fastening mechanism 10 of the present invention, the first connecting element 12 and the second connecting element 14 are adjacently positioned such that the flexible arm 28a of the first connecting element 12 is approximate the female portion sleeve 42b of the second connecting element 14 and the flexible arm 28b of the second connecting element 14 is approximate the female portion sleeve 42a of the first connecting element 12. Next, the flexible areas 28a, 28b of the first connecting element 12 and the second connecting element 14, respectively, are inserted into the female portion sleeves 42b, 42a of the second connecting element 14 and the first connecting element 12, respectively. Due to the protruding portions 38a, 38b on the first connecting element 12 and the second connecting element 14, respectively, extending away from the respective flexible arms 28a, 28b, the protruding portions 38a, 38b contact the opposite female portion sleeves 42a, 42b causing the flexible arms 28a, 28b to flex inward toward the flexible arms' respective female portion sleeve 42a, 42b. Then, as the first connecting element 12 and the second connecting element 14 continue to be moved toward each, the protruding portions 38a, 38b on the first connecting element 12 and the second connecting element 14 will reach the apertures 46b, 46a on the second connecting element 14 and the first connecting element 12, respectively, and the flexible arms 28a, 28b will return to their original state with each protruding portion 38a, 38b extending into the opposite connecting element's aperture 46b, 46a. The protuberances 40a, 40b on the respective protruding portions 38a, 38b hook into engagement with the respective female portion sleeve 42a, 42b thereby releasably securing the first connecting element 12 to the second connecting element 14 and inhibiting accidental unfastening of the fastening mechanism 10.

To disconnect the fastening mechanism 10 of the present invention and thereby release the first connecting element 12 from the second connecting element 14, the flexible arms 28a, 28b on the first and second connecting elements 12, 14, respectively, are urged inward until the protruding portions 38a, 38b and the protuberances 40a, 40b are free from their opposite female portion sleeves 42b, 42a thereby releasing the engagement of the protuberances 40*a*, 40*b* on the opposite female portion sleeves 42*b*, 42*a*. The first connecting element 12 is then moved away from the second connecting element 14 until the flexible arms 28*a*, 28*b* of the first and second connecting elements 12, 14, respectively, are free from the opposite female portion sleeves 42*b*, 42*a* of the second and first connecting elements 14, 12, respectively.

In the embodiments of the fastening mechanism 10 of the present invention as illustrated in FIGS. 7–10, wherein the fastening mechanism 10 comprises the guide bar 48*a*, 48*b* and the guide plate 50*a*, 50*b*, the engagement and disengagement of the first connecting element 12 to the second connecting element 14 is similar to the procedure as described above. As the first connecting element 12 and the second connecting element 14 are moved together, the guide bar 48*a* of the first connecting element 12 glides into the defined area 52*b* of the second connecting element 14 and the guide bar 48*b* of the second connecting element 14 glides into the defined area 50*a* of the first connecting element 12. The interaction of the guide bars 48*a*, 48*b* and the defined areas 50*a*, 50*b* on the first and second connecting elements 12, 14 assist in aligning and connecting together the first and second connecting elements 12, 14. Furthermore, the guide bars 48*a*, 48*b* together with the guide plates 50*a*, 50*b* further inhibit accidental disengagement of the first and second connecting elements 12, 14 which might occur due to rotational movement of the first and second connecting elements 12, 14.

Thus, in effect, with the fastening mechanism 10 of the present invention, each of the first and second connecting elements 12, 14 perform a dual male/female function by incorporating one-half of the above-mentioned male construction and one-half of the above-mentioned female construction so that each part now is substantially, if not actually, identical to one another. The first and second connecting elements 12, 14 are interchangeable with one another and positionable in reversed orientation with respect to one another for use in the form of a buckle for articles or straps. Stated differently, the fastening mechanism 10 of the present invention utilizes two similar connecting elements in reverse, upside down positions with respect to each other when in the engaged position.

As described and illustrated herein, the fastening mechanism 10 of the present invention incorporates a new construction avoiding the necessity to provide dedicated male and female connector elements thereby eliminating the above-described disadvantages associated therewith. From the standpoint of commercial manufacture, since there is only one part molded of a plastic material, the fastening mechanism 10 of the present invention can be produced very inexpensively. Since the basic components are few and the shapes thereof are simple, the fastening mechanism 10 enjoys a very broad freedom of design in both structural and ornamental senses.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A fastening mechanism comprising:

a first connecting element having a first attachment arm portion, a first sleeve portion, a first guide bar, and a first receiving opening, the first guide bar positioned adjacent the first attachment arm portion between the first attachment arm portion and the first sleeve portion, the first receiving opening positioned adjacent the first sleeve portion between the first guide bar and the first sleeve portion, the first guide bar being supported by the first sleeve portion at least partially along its length between the first attachment arm portion and the first sleeve portion;

a first receiving aperture formed in the first sleeve portion;

a second connecting element having second attachment arm portion, a second sleeve portion, a second guide bar, and a second receiving opening, the second guide bar positioned adjacent the second attachment arm portion between the second attachment arm portion and the second sleeve portion, the second receiving opening positioned adjacent the second sleeve portion between the second guide bar and the second sleeve portion, the second guide bar being supported by the second sleeve portion at least partially along its length between the second attachment arm portion and the second receiving portion;

a second receiving aperture formed in the second sleeve portion;

wherein the first attachment arm portion of the first element matingly connects with the second receiving aperture of the second element, the second attachment arm portion of the second element matingly connects with the first receiving portion of the first element and further the first receiving opening receives the second guide bar and the second receiving opening receives the first guide bar.

2. A fastening apparatus for connecting at least two articles together, the mechanism comprising:

a pair of reversible, interchangeable connector elements, one connector element connectable to one of the articles, the other connector element being connectable to the other article, each connector element releasably matingly connecting to the other connector element for connecting the articles together;

a guide bar formed on each of the connecting elements, each guide bar being at least partially supported along its length; and a receiving opening formed on each of the connecting elements wherein upon connecting the connector elements together, the receiving opening on each connecting element matingly receiving the guide bar on the other connecting element.

3. A method of connecting a first article to a second article, the method comprising:

providing a first connecting element and a second connecting element, the second connecting element being substantially identical to the first connecting element;

forming a first guide bar onto the first connecting element and supporting the first guide bar at least partially along its length;

forming a first receiving opening into the first connecting element;

forming a second guide bar onto the second connecting element and supporting the second guide bar at least partially along is length;

forming a second receiving opening into the second connecting element; and matingly connecting the first connecting element to the second connecting element, such that the first receiving opening receives the second guide bar and the second receiving opening receives by the first guide bar.

4. The method of claim 3 and further comprising:

forming a first male portion onto the first connector element;

forming a first female portion into the first connector element;

forming a second male portion onto the second connector element;

forming a second female portion into the second connector element; and matingly connecting the first male portion to the second female portion and the second male portion to the first female portion thereby releasably connecting the first connector element to the second connector element.

5. The method of claim 4 wherein the first male portion of the first connecting element comprises a first arm and the second male portion of the second connecting element comprises a second arm.

6. The method of claim 5 wherein the first arm of the first connecting element has a first protruding portion and the second arm of the second connecting element has a second protruding portion wherein upon connecting the first connecting element to the second connecting element, the method further comprising extending the first protruding portion into the second female portion and extending the second protruding portion into the first female portion.

7. The method of claim 6 wherein the first and second protruding portions have a protuberance interacting with the first and second female portions, respectively, the protuberances inhibiting the first and second protruding portions from disengaging the first and second female portions.

8. The method of claim 5 wherein the first female portion of the first connecting element comprises a first slot formed in the first connecting element and the second female portion of the second connecting element comprises a second slot formed in the second connecting element, each slot having an aperture formed therein.

* * * * *